US008126179B2

(12) United States Patent
Kondo et al.

(10) Patent No.: US 8,126,179 B2
(45) Date of Patent: Feb. 28, 2012

(54) DIAPHRAGM AND SOUND OUTPUT APPARATUS

(75) Inventors: Tetsujiro Kondo, Tokyo (JP); Junichi Shima, Kanagawa (JP); Akihiko Arimitsu, Kanagawa (JP); Takuro Ema, Tokyo (JP)

(73) Assignee: Sony Corporation, Tokyo (JP)

( * ) Notice: Subject to any disclaimer, the term of this patent is extended or adjusted under 35 U.S.C. 154(b) by 950 days.

(21) Appl. No.: 12/126,411

(22) Filed: May 23, 2008

(65) Prior Publication Data

US 2009/0028368 A1 Jan. 29, 2009

(30) Foreign Application Priority Data

Jul. 24, 2007 (JP) ..... 2007-191596

(51) Int. Cl.
*H01C 1/148* (2006.01)

(52) U.S. Cl. ..... 381/332; 381/59; 381/385; 181/148; 181/157; 181/171; 181/173

(58) Field of Classification Search ..... 336/332, 336/96, 59; 181/141, 143, 148, 157, 171, 181/172, 173
See application file for complete search history.

(56) References Cited

U.S. PATENT DOCUMENTS

| | | | | |
|---|---|---|---|---|
| 2,916,562 | A * | 12/1959 | Kuehn | 381/387 |
| 3,696,885 | A * | 10/1972 | Grieg et al. | 181/141 |
| 3,985,201 | A * | 10/1976 | Kloster | 181/163 |
| 4,488,012 | A * | 12/1984 | Matsuda et al. | 381/96 |
| 4,792,978 | A * | 12/1988 | Marquiss | 381/431 |
| 6,420,818 | B1 * | 7/2002 | Kishimoto et al. | 310/324 |
| 6,525,249 | B1 * | 2/2003 | Suenaga | 84/411 R |
| 6,731,764 | B2 * | 5/2004 | Asada et al. | 381/152 |
| 6,804,367 | B2 * | 10/2004 | Asada et al. | 381/398 |
| 6,888,947 | B2 * | 5/2005 | Takeshima et al. | 381/190 |
| 7,548,766 | B2 * | 6/2009 | Takahata et al. | 455/569.1 |
| 8,031,902 | B2 * | 10/2011 | Takewa | 381/431 |
| 2002/0012439 | A1 * | 1/2002 | Schafer | 381/349 |
| 2007/0223734 | A1 * | 9/2007 | Suzuki et al. | 381/96 |

FOREIGN PATENT DOCUMENTS

| | | |
|---|---|---|
| JP | 2004-356868 | 12/2004 |
| JP | 2005-94377 | 4/2005 |
| JP | 3905814 | 1/2007 |
| JP | 2007-67538 | 3/2007 |

OTHER PUBLICATIONS

Office Action issued Apr. 19, 2011, in Japan Patent application No. 2007-191596.

* cited by examiner

*Primary Examiner* — Anh Mai
*Assistant Examiner* — Joselito Baisa
(74) *Attorney, Agent, or Firm* — Oblon, Spivak, McClelland, Maier & Neustadt, L.L.P.

(57) ABSTRACT

A diaphragm for outputting sound by vibrating has a hole of a predetermined shape that allows another member to extend therethrough. A sound output apparatus includes a first member, the diaphragm, and a second member. The first member extends through the hole of the diaphragm, and the first member is screwed into the second member.

7 Claims, 9 Drawing Sheets

DIAPHRAGM AND SOUND OUTPUT APPARATUS

CROSS REFERENCES TO RELATED APPLICATIONS

The present invention contains subject matter related to Japanese Patent Application JP 2007-191596 filed in the Japanese Patent Office on Jul. 24, 2007, the entire contents of which are incorporated herein by reference.

BACKGROUND OF THE INVENTION

1. Field of the Invention

The present invention relates to diaphragms and sound output apparatuses. More specifically, the present invention relates to a diaphragm and a sound output apparatus in which no sound degradation due to the weight of a sound output portion occurs.

2. Description of the Related Art

Japanese Unexamined Patent Application Publication No. 2007-67538 discloses a screen speaker unit that functions as a speaker for outputting sound as well as a screen for dividing a room or hiding undesirable views.

Screen speakers typically use a rectangular diaphragm. Japanese Patent No. 3905814 and Japanese Unexamined Patent Application Publication No. 2004-356868, for example, disclose structures for improving sound quality of speakers that use a rectangular diaphragm.

SUMMARY OF THE INVENTION

FIG. 1 shows a diaphragm retainer mechanism of a screen speaker unit disclosed in Japanese Unexamined Patent Application Publication No. 2007-67538, viewed from above. Fixing members 2 having screws are fixed to a main frame 1 by nuts 3. A diaphragm 4 is fixedly supported by the fixing members 2 through the intermediary of cushioning members 5.

However, the diaphragm 4 may gradually slip down under its own weight because the cushioning members 5 exert a weak urging force on the diaphragm 4. As a result, the diaphragm 4 may weigh on a supporting member (not shown) provided below the diaphragm 4, and friction between the supporting member and the diaphragm 4 may produce undesirable sound.

The diaphragm retainer mechanism disclosed in Japanese Unexamined Patent Application Publication No. 2007-67538 retains the left and right edges of the diaphragm 4 with the diaphragm retainers having a U-shaped cross section. However, the mechanism is not designed to support the weight of the diaphragm 4. Thus, the diaphragm 4 may gradually slip down under its own weight. If the diaphragm retainers support the weight of the diaphragm 4, the diaphragm retainers may interfere with the diaphragm 4, resulting in frictional and fluttering sounds.

The speakers disclosed in Japanese Patent No. 3905814 and Japanese Unexamined Patent Application Publication No. 2004-356868 have mechanisms that support the diaphragms by applying pressure. This may make it difficult to mount the diaphragms. Further, the diaphragms may be damaged by the pressure.

The present invention has been made in view of these situations, and it is desirable to provide a sound output apparatus that outputs high-quality sound.

A diaphragm according to an embodiment of the present invention outputs sound by vibrating, and has a hole of a predetermined shape that allows another member to extend therethrough.

The hole may have a size allowing a cushioning member to be disposed between the other member and the hole in the diaphragm.

The diaphragm may be rectangular, the hole may be provided in the vicinity of an edge of the diaphragm, and the edge may be fixed.

The hole may be provided in the vicinity of a short edge of the diaphragm, and the short edge may be fixed.

A diaphragm according to an embodiment of the present invention has a hole that allows another member to extend therethrough.

A sound output apparatus according to an embodiment of the present invention has a first member, a diaphragm having a hole of a predetermined shape through which the first member extends, and a second member into which the first member is screwed.

A cushioning member may be disposed between the diaphragm and the first member extending through the hole.

A first plate may connect to the first member, the first plate being attached to one surface of the diaphragm. A second plate may have a hole, one surface of the second plate being attached to the other surface of the diaphragm. A frame to which the diaphragm is fixed may be arranged adjacent to the other surface of the second plate and have a hole. The first member may extend through the hole in the diaphragm, the hole in the second plate, and the hole in the frame. The diaphragm may be fixed to the frame by the first and second members being screwed together, while being disposed between the first and second plates.

The diaphragm may be rectangular, the first and second plates may be attached to a short edge of the diaphragm, and a cushioning member may be disposed along a long edge of the diaphragm, between the diaphragm and the frame.

The second plate may have a thickness sufficient to prevent the diaphragm from contacting the frame when the diaphragm vibrates.

The size of a vibrating surface of the diaphragm may be changed by changing the width of the second plate.

The hole in the second plate may be elongated in a longitudinal direction of the diaphragm. The second plate may be movable in the longitudinal direction of the diaphragm.

The diaphragm and a cushioning member may be disposed between the first and second plates.

In the sound output apparatus according to an embodiment of the present invention, the first member extends through the hole in the diaphragm and screws into the second member, whereby the diaphragm is fixed to a predetermined frame.

The sound output apparatus according to an embodiment of the present invention outputs high-quality sound.

DESCRIPTION OF THE PREFERRED EMBODIMENTS

Embodiments of the present invention will now be described. The correspondence relationship between the claimed elements and the embodiments disclosed in the specification or the drawings is as follows. This description confirms that the embodiments supporting the present invention are disclosed in the specification or the drawings. Accordingly, even if the correspondence between an embodiment disclosed in the specification or the drawings and a claimed element is not described herein, it does not mean that there is no correspondence between the embodiment and the claimed element. By contrast, even if the correspondence between an embodiment and a claimed element is described herein, it does not mean that there is no correspondence between the embodiment and another claimed element.

A diaphragm according to an embodiment of the present invention (e.g., a diaphragm 31-2 in FIG. 3 or diaphragms 31 in FIGS. 8A and 8B) outputs sound by vibrating. The diaphragm has a hole (e.g., a hole 53A-1 in FIG. 3) of a predetermined shape. Another member (e.g., a bolt 51A-1 in FIG. 3) is configured to extend through the hole.

The hole may have a size allowing a cushioning member (e.g., cushioning members 52 in FIG. 3) to be disposed between the other member and the hole in the diaphragm.

Figure 3:
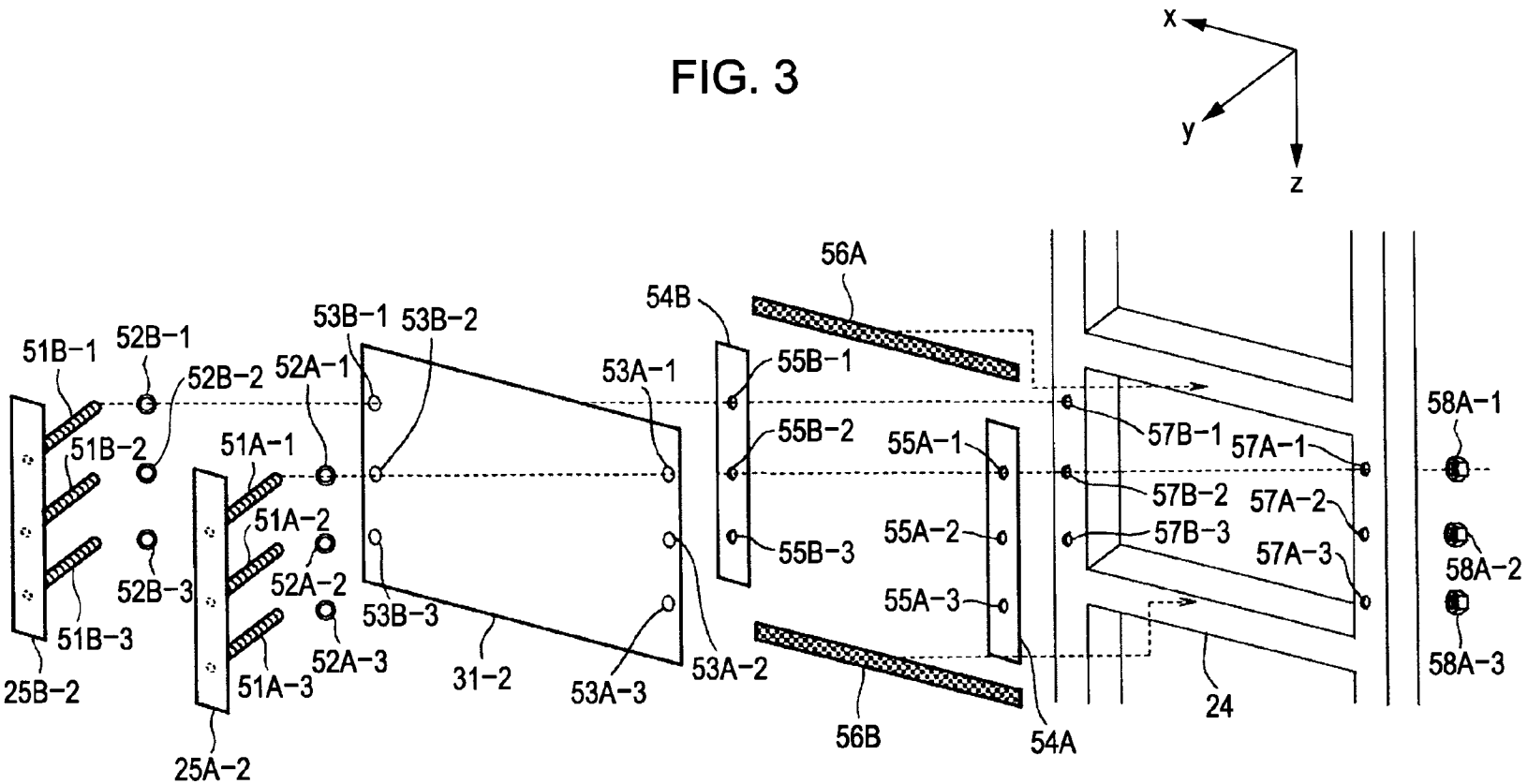
FIG. 3 shows a retainer mechanism according to an embodiment of the present invention.

The diaphragm may be rectangular, the hole may be provided in the vicinity of an edge of the diaphragm, and the edge may be fixed (e.g., the diaphragm 31-2 in FIG. 3).

The hole may be provided in the vicinity of a short edge of the diaphragm, and the short edge may be fixed (e.g., the diaphragm 31-2 in FIG. 3).

A sound output apparatus according to an embodiment of the present invention (e.g., a screen speaker unit 11 in FIG. 2) has a first member (e.g., the bolt 51A-1 in FIG. 3), a diaphragm (e.g., the diaphragm 31-2 in FIG. 3 or the diaphragms 31 in FIGS. 8A and 8B) having a hole (e.g., the hole 53A-1 in FIG. 3) of a predetermined shape through which the first member extends, and a second member (e.g., a nut 58A-1 in FIG. 3) into which the first member is screwed.

A cushioning member (e.g., the cushioning member 52A-1 in FIG. 3) may be disposed between the diaphragm and the first member extending through the hole.

A first plate (e.g., a plate 25A-2 in FIG. 3) may connect to the first member, the first plate being attached to one surface of the diaphragm. A second plate (e.g., a plate 54A in FIG. 3) may have a hole, one surface of the second plate being attached to the other surface of the diaphragm. A frame (e.g., a frame 24 in FIG. 3) to which the diaphragm is fixed may be arranged adjacent to the other surface of the second plate and have a hole. The first member may extend through the hole (e.g., the hole 53A-1 in FIG. 3) in the diaphragm, the hole (e.g., a hole 55A-1 in FIG. 3) in the second plate, and the hole (e.g., a hole 57A-1 in FIG. 3) in the frame. The diaphragm may be fixed to the frame by the first and second members being screwed together, while being disposed between the first and second plates (e.g., the diaphragm 31-2 in FIG. 3).

Figure 5:
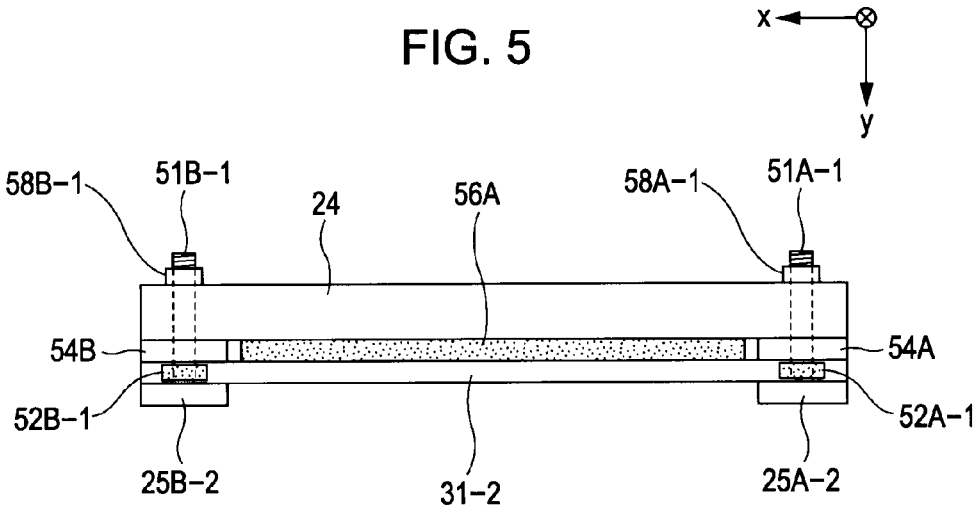
FIG. 5 shows a detailed structure of the retainer mechanism.

The diaphragm may be rectangular, the first and second plates may be attached to a short edge of the diaphragm, and a cushioning member may be disposed along a long edge of the diaphragm, between the diaphragm and the frame (e.g., a cushioning member 56A in FIG. 5).

Figure 10:
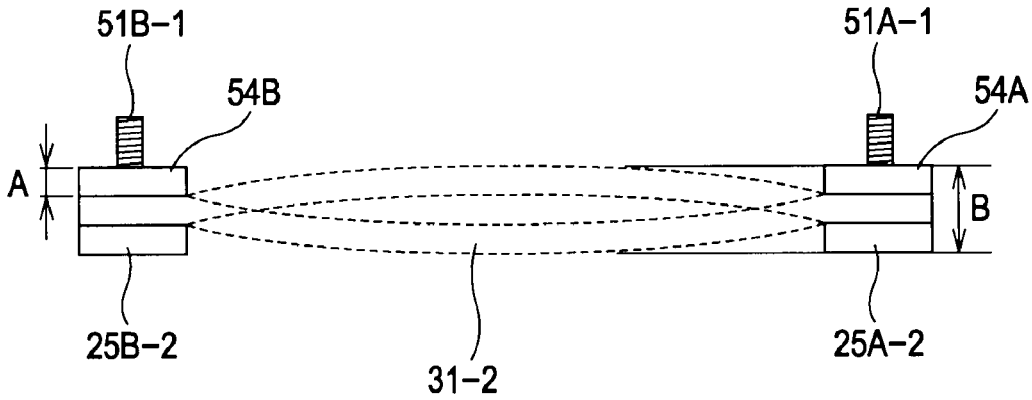
FIG. 10 shows a structure for customizing sound quality.

The second plate may have a thickness sufficient to prevent the diaphragm from contacting the frame when the diaphragm vibrates (e.g., the plates 54A and 54B in FIG. 10).

The size of a vibrating surface of the diaphragm may be changed by changing the width of the second plate.

The hole in the second plate may be elongated (e.g., a hole 55A"-1 in FIG. 12) in a longitudinal direction of the diaphragm. The second plate may be movable in the longitudinal direction of the diaphragm.

Embodiments of the present invention will now be described with reference to the drawings.

Figure 2:
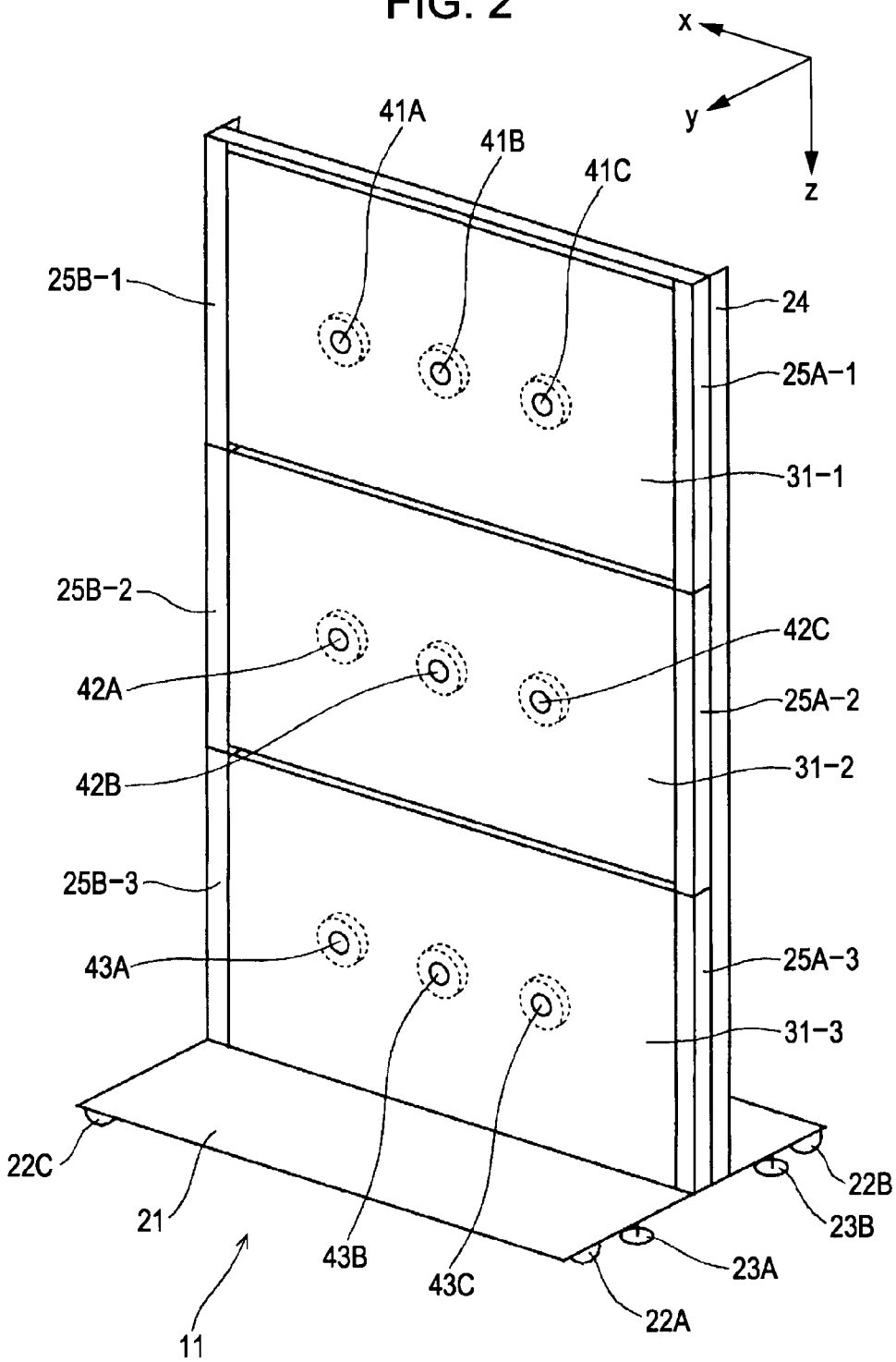
FIG. 2 shows a structure of a screen speaker unit.

FIG. 2 shows a structure of the screen speaker unit 11 according to an embodiment of the present invention. The screen speaker unit 11 functions as a speaker as well as a screen, and is an exemplary sound output apparatus of the present invention.

The screen speaker unit 11 includes a base 21, casters 22A to 22D, supporting members 23A to 23D, the frame 24, the plates 25A-1 to 25B-3, the diaphragms 31-1 to 31-3, and vibrators 41A to 43C.

The base 21 is made of a material strong enough to support the frame 24, for example, a metal such as iron, aluminum, magnesium, or titanium. The base 21 has the casters 22A to 22D (the caster 22D is not shown) at the four corners of the lower surface thereof, and the supporting members 23A to 23D (the supporting members 23C and 23D are not shown) adjacent to the casters 22A to 22D. A user can move the screen speaker unit 11 placed in a room, for example, by pushing it to cause the casters 22A to 22D to roll on the floor. The supporting members 23A to 23D contact the floor to support the screen speaker unit 11.

That is, a user can move the screen speaker unit 11 to a desired position.

The frame 24 is, for example, welded to the upper surface of the base 21 and stands upright on the base 21.

Although a detailed description will be given below, the frame 24 has a mechanism for supporting the weight of the diaphragms 31-1 to 31-3, and the plates 25A-1 to 25B-3 for fixing the diaphragms 31-1 to 31-3 so as not to move in the front-back direction in FIG. 2. The diaphragms 31-1 to 31-3 are removably fixed to the frame 24 by the mechanism and the plates 25A-1 to 25B-3. Although a detailed description will be given below, the frame 24 and the plates 25A-1 to 25B-3 support the diaphragms 31-1 to 31-3 so as not to move downward or in the front-back direction.

The weight of the diaphragm 31-1 is supported by the below-described mechanism, and the plates 25A-1 and 25B-1 support the diaphragm 31-1 so as not to move in the front-back direction. Similarly to the diaphragm 31-1, the weight of the diaphragm 31-2 is supported by the below-described mechanism, and the plates 25A-2 and 25B-2 support the diaphragm 31-2 so as not to move in the front-back direction. The weight of the diaphragm 31-3 is supported by the below-described mechanism, and the plates 25A-3 and 25B-3 support the diaphragm 31-3 so as not to move in the front-back direction.

The diaphragms 31-1 to 31-3 are arranged vertically along the frame 24 and removably fixed thereto. The screen speaker unit 11 is structured to serve as a screen having a predetermined height from the floor.

The diaphragms 31-1 to 31-3 are formed in a plate shape. Examples of the material of the diaphragms 31-1 to 31-3 include plasterboard, wood such as medium density fiberboard (MDF), aluminum plate, resin such as carbon resin or acrylic resin, and glass. The diaphragms 31-1 to 31-3 may also be formed from a composite material made by combining or laminating different materials together.

Each of the diaphragms 31-1 to 31-3 has a plurality of vibrators (three vibrators in FIG. 2) arranged horizontally in a line. The diaphragm 31-1 has vibrators 41A to 41C, the diaphragm 31-2 has vibrators 42A to 42C, and the diaphragm 31-3 has vibrators 43A to 43C arranged horizontally in a line.

When the vibrators 41A to 43C are driven by a sound source (not shown), such as an amplifier, they, according to a sound signal from the sound source, cause the diaphragms 31-1 to 31-3 to vibrate and output sound. Thus, the screen speaker unit 11 serves as a speaker for converting a sound signal into sound.

The vibrators 41A to 43C are removably attached to predetermined positions of the diaphragms 31-1 to 31-3, depending on the vibration characteristics of the diaphragms 31-1 to 31-3.

Although FIG. 2 shows the screen speaker unit 11 having three diaphragms, namely, the diaphragms 31-1 to 31-3, the number of the diaphragms 31 does not necessarily have to be three in the present invention, and one or more diaphragms 31 may be removably fixed to the frame 24. That is, a user can customize the height of the screen speaker unit 11 by vertically arranging a desired number of the diaphragms 31.

In the following description, the plates 25A-1 to 25B-3 will be referred to as the plates 25, the plates 25A-1, 25A-2, and 25A-3 will be referred to as the plates 25A, and the plates 25B-1, 25B-2, and 25B-3 will be referred to as the plates 25B, when they do not have to be distinguished.

Also in the following description, the left-right direction with respect to the screen speaker unit 11 (the left-right direction in FIG. 2) will be referred to as an x-axis direction, the front-back direction (the direction penetrating through the paper in FIG. 2) will be referred to as a y-axis direction, and the top-bottom direction in FIG. 2 will be referred to as a z-axis direction.

FIG. 3 shows a retainer mechanism for retaining the diaphragms 31. Although FIG. 3 shows the retainer mechanism for retaining the diaphragm 31-2, basically the same retainer mechanisms are used for the diaphragms 31-1 and 31-3.

The plates 25A-2 and 25B-2 are provided on the front surface (in the y-axis direction) of the diaphragm 31-2. The plates 25A-2 and 25B-2 are attached to both edges in the x-axis direction of the diaphragm 31-2.

The plate 25A-2 has the bolts 51A-1, 51A-2, and 51A-3, and the plate 25B-2 has the bolts 51B-1, 51B-2, and 51B-3. The bolts 51A-1 to 51A-3 are welded, for example, to the plate 25A-2, and the bolts 51B-1 to 51B-3 are welded, for example, to the plate 25B-2.

As shown in FIG. 2, the plates 25 are positioned on the front surface of the screen speaker unit 11, in other words, they are viewed by a user. It is preferable that the surfaces of the plates 25 viewed by a user (i.e., the surfaces on the left, opposite to the surfaces provided with the bolts 51A-1 to 51B-3, in FIG. 3) be finished smoothly because the screen speaker unit 11 also serves as a screen. Thus, as shown in FIG. 3, it is preferable that the bolts 51A-1 to 51B-3 be welded to the plates 25, so that they are not viewed by a user.

Although the plates 25 shown in FIG. 3 are rectangular, they may be folded plates having an L-shaped cross section, for example, so that they can cover the sides of the frame 24. That is, as shown in FIG. 2, the plates 25 may cover the sides of the frame 24 to conceal the frame 24 from a user.

Referring back to FIG. 3, the diaphragm 31-2 has the holes 53A-1 to 53A-3 and the holes 53B-1 to 53B-3 provided in the vicinity of both edges in the x-axis direction thereof. The holes 53A-1 to 53A-3 are provided such that the bolts 51A-1 to 51A-3 can respectively extend therethrough, and the holes 53B-1 to 53B-3 are provided such that the bolts 51B-1 to 51B-3 can respectively extend therethrough.

Figure 4A:
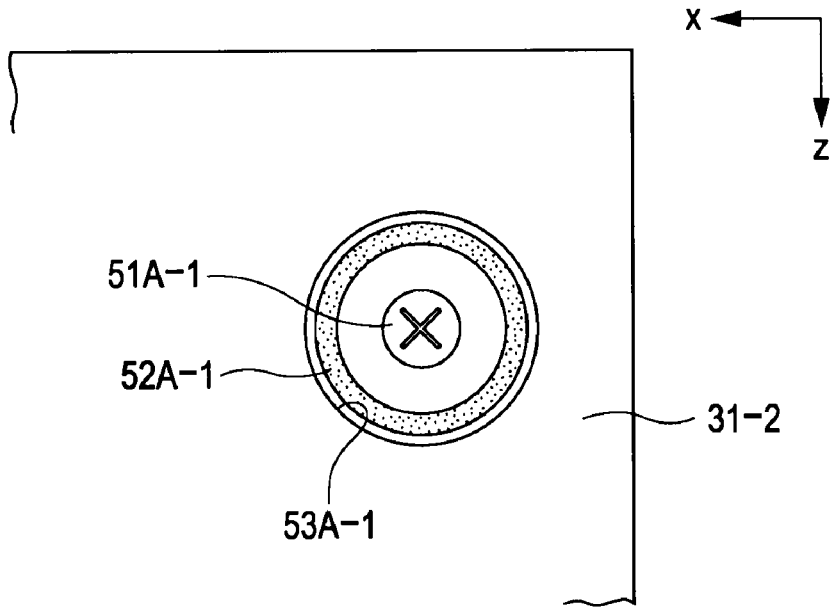
FIGS. 4A and 4B are a plan view and a side view of a cushioning member, respectively.
Figure 4B:
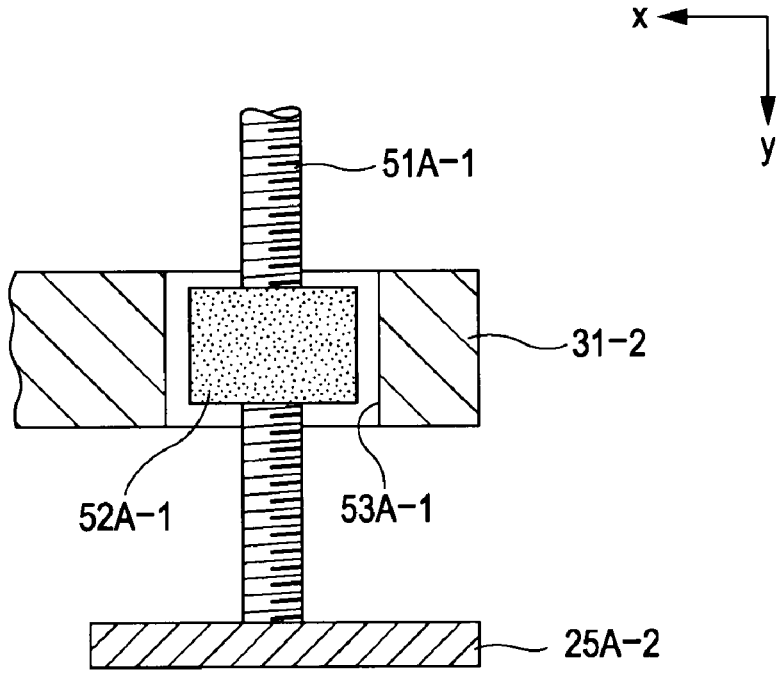

The cushioning member 52A-1 is disposed between the hole 53A-1 in the diaphragm 31-2 and the bolt 51A-1, so that the diaphragm 31-2 and the bolt 51A-1 do not contact with each other. This structure will be described with reference to FIGS. 4A and 4B. FIG. 4A shows the cushioning member 52A-1 viewed in the y-axis direction, and FIG. 4B shows the cushioning member 52A-1 viewed in the z-axis direction.

Referring to FIG. 4A, the cushioning member 52A-1 having an outside diameter smaller than the diameter of the hole 53A-1 is placed in the hole 53A-1 in the diaphragm 31-2. The bolt 51A-1 having a diameter smaller than the inside diameter of the cushioning member 52A-1 extends through the cushioning member 52A-1. Referring to FIG. 4B, the cushioning member 52A-1 is sized to be placed in the hole 53A-1 in the diaphragm 31-2.

The inner periphery of the hole 53A-1 in the diaphragm 31-2 and the outer periphery of the cushioning member 52A-1 may be in contact (tight contact) with each other. In other words, the diameter of the hole 53A-1 in the diaphragm 31-2 and the outer diameter of the cushioning member 52A-1 may be either substantially the same, or different to leave a gap therebetween. Similarly, the inner periphery of the cushioning member 52A-1 and the outer periphery of the bolt 51A-1 may be in contact (tight contact) with each other. In other words, the inner diameter of the cushioning member 52A-1 and the diameter of the bolt 51A-1 may be either substantially the same, or different to leave a gap therebetween.

This configuration prevents the diaphragm 31-2 and the bolt 51A-1 from contacting each other when the diaphragm 31-2 vibrates, and makes the cushioning member 52A-1 absorb noise produced by the bolt 51A-1 and the diaphragm 31-2 contacting each other, thereby reducing the noise.

Referring back to FIG. 3, as described above, the cushioning member 52A-1 is disposed between the hole 53A-1 in the diaphragm 31-2 and the bolt 51A-1. The cushioning member 52A-2 is disposed between the hole 53A-2 in the diaphragm 31-2 and the bolt 51A-2, and the cushioning member 52A-3 is disposed between the hole 53A-3 in the diaphragm 31-2 and the bolt 51A-3. In the same manner, the cushioning member 52B-1 is disposed between the hole 53B-1 in the diaphragm 31-2 and the bolt 51B-1, the cushioning member 52B-2 is disposed between the hole 53B-2 in the diaphragm 31-2 and the bolt 51B-2, and the cushioning member 52B-3 is disposed between the hole 53B-3 in the diaphragm 31-2 and the bolt 51B-3.

The plate 54A having the holes 55A-1 to 55A-3 that allow the bolts 51A-1 to 51A-3 to extend therethrough is fitted to the surface of the diaphragm 31-2, opposite to the surface provided with the plate 25A-2. In the same manner, the plate 54B having the holes 55B-1 to 55B-3 that allow the bolts 51B-1 to 51B-3 to extend therethrough is fitted to the surface of the diaphragm 31-2, opposite to the surface provided with the plate 25B-2.

These plates 54A and 54B serve to create a space in which the diaphragm 31-2 vibrates in the front-back direction (y-axis direction). Although a detailed description will be given below with reference to FIG. 5, because the diaphragm 31-2 vibrates in the front-back direction to output sound, the plates 54A and 54B are provided to prevent the diaphragm 31-2 from contacting the frame 24, and to prevent the frame 24 from inhibiting the vibration.

The cushioning members 56A and 56B are provided along the top and bottom edges (in the Z-axis direction) of the diaphragm 31-2, to prevent the diaphragm 31-2 from contacting the frame 24 when the diaphragm 31-2 vibrates. The cushioning members 56A and 56B are made of a material that does not inhibit the vibration of the diaphragm 31-2 even when it contacts the diaphragm 31-2, and a material that protects the diaphragm 31-2 from being damaged by contacting the frame 24.

The frame 24 has the holes 57A-1 to 57A-3 that allow the bolts 51A-1 to 51A-3 of the plate 25A-2 to respectively extend therethrough, and the holes 57B-1 to 57B-3 that allow the bolts 51B-1 to 51B-3 of the plate 25B-2 to respectively extend therethrough.

The bolt 51A-1 extending through the hole 57A-1 screws into the nut 58A-1, the bolt 51A-2 extending through the hole 57A-2 screws into the nut 58A-2, and the bolt 51A-3 extending through the hole 57A-3 screws into the nut 58A-3.

In the same manner, the bolt 51B-1 extending through the hole 57B-1 screws into the nut 58B-1, the bolt 51B-2 extending through the hole 57B-2 screws into the nut 58B-2, and the bolt 51B-3 extending through the hole 57B-3 screws into the nut 58B-3.

Thus, the diaphragm 31-2 is fixed to the frame 24 by the bolts 51A-1 to 51A-3 and the nuts 58A-1 to 58A-3, and the bolts 51B-1 to 51B-3 and the nuts 58B-1 to 58B-3 being screwed together.

Referring to FIG. 5, a mechanism for fixing the diaphragm 31-2 to the frame 24 will be described in detail. FIG. 5 shows the diaphragm 31-2 fixed to the frame 24, viewed from above (viewed in the z-axis direction).

As described above with reference to FIGS. 4A and 4B, and as shown in FIG. 5, the cushioning member 52A-1 is thinner than the diaphragm 31-2 and is sized to be placed in the hole 53A-1 in the diaphragm 31-2. Thus, the plates 25A-2 and 54A contact the diaphragm 31-2, as shown in FIG. 5. In the same manner, the cushioning member 52B-1 is thinner than the diaphragm 31-2 and is sized to be placed in the hole 53B-1 in the diaphragm 31-2. Thus, the plates 25B-2 and 54B contact the diaphragm 31-2, as shown in FIG. 5.

The diaphragm 31-2, while being directly disposed between the frame 24 and the plates 25A-2 and 25B-2, is fixedly fastened to the frame 24 by the bolt 51A-1 fixed to the plate 25A-2 and the nut 58A-1 being screwed together so as not to move in the front-back direction (y-axis direction).

Referring to FIG. 5, the cushioning member 56A is disposed between the diaphragm 31-2 and the frame 24. The thickness of the cushioning member 56A is set such that it does not exert a force on the diaphragm 31-2 when the diaphragm 31-2 is not vibrated. The cushioning member 56A serves to prevent the diaphragm 31-2 from contacting the frame 24 when the diaphragm 31-2 vibrates. Thus, the thickness of the cushioning member 56A is set to be equal to or smaller than the distance between the diaphragm 31-2 and the frame 24. Although it is not shown in FIG. 5, the cushioning member 56B is disposed in the same manner as the cushioning member 56A.

As can be seen from FIG. 5, the distance between the diaphragm 31-2 and the frame 24 is equal to the thickness of the plates 54A and 54B (the following description will be based on the plate 54A). Accordingly, the cushioning member 56A has a thickness equal to or smaller than the plate 54A.

It is preferable that the diaphragm 31-2 do not contact the frame 24 while vibrating. Even if the diaphragm 31-2 contacts the frame 24, the resulting noise should preferably be suppressed. Thus, the thickness of the plate 54A is set such that it prevents the diaphragm 31-2 from contacting the frame 24 when the diaphragm 31-2 vibrates.

The plate 54A is made of the same material as the frame 24 and has sufficient strength. The thickness of the plate 54A is determined in relation to the diaphragm 31-2, as described above. The plate 54B has the same shape as the plate 54A.

Figure 6:
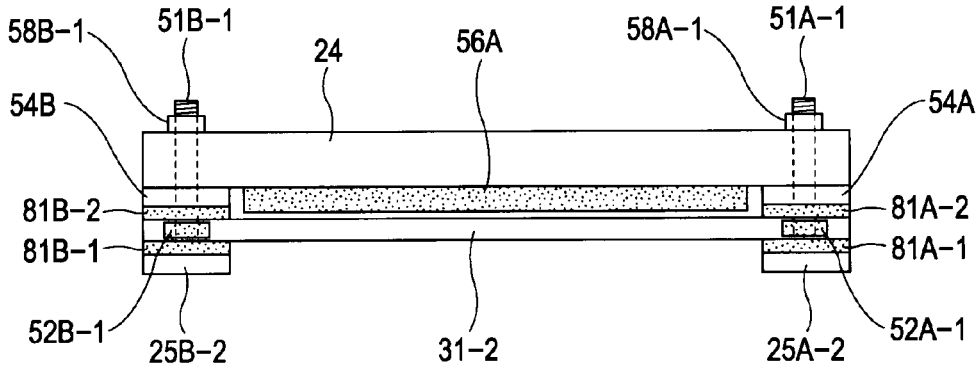
FIG. 6 shows a detailed structure of another retainer mechanism.

FIG. 6 shows another retainer mechanism using cushioning members. In the structure shown in FIG. 5, the diaphragm 31-2 directly contacts the plates 25A-2, 25B-2, 54A, and 54B. In contrast, in the structure shown in FIG. 6, the diaphragm 31-2 contacts the plates 25A-2, 25B-2, 54A, and 54B with the cushioning members therebetween.

A cushioning member 81A-1 is disposed between the plate 25A-2 and the diaphragm 31-2. A cushioning member 81A-2 is disposed between the plate 54A and the diaphragm 31-2. In the same manner, a cushioning member 81B-1 is disposed between the plate 25B-2 and the diaphragm 31-2, and a cushioning member 81B-2 is disposed between the plate 54B and the diaphragm 31-2. These cushioning members 81A-1, 81A-2, 81B-1, and 81B-2 each have a hole (not shown) that allows the bolt 51A-1 or 51B-1 to extend therethrough.

The cushioning members 81 disposed between the diaphragm 31-2 and the plates 25 and between the diaphragm 31-2 and the plates 54 prevent the diaphragm 31-2 from contacting the plates 25 and 54 and producing undesirable noise, and prevent the diaphragm 31-2 from wearing. The cushioning members 81 are made of, for example, rubber or hard sponge.

As has been described, in the present embodiment, in order to prevent the diaphragms 31 from slipping down under their own weight, each diaphragm 31 has the holes 53 and allows the bolts 51 to extend therethrough, whereby the diaphragms 31 are supported. Further, the cushioning members 52 are provided to prevent the diaphragms 31 from contacting the bolts 51 and producing undesirable noise. Thus, the diaphragms 31 are prevented from slipping down under their own weight, while sound degradation is suppressed. In addition, a fluttering sound due to vibration can be reduced because the diaphragms 31 are fixedly fastened to the frame 24.

Figure 1:
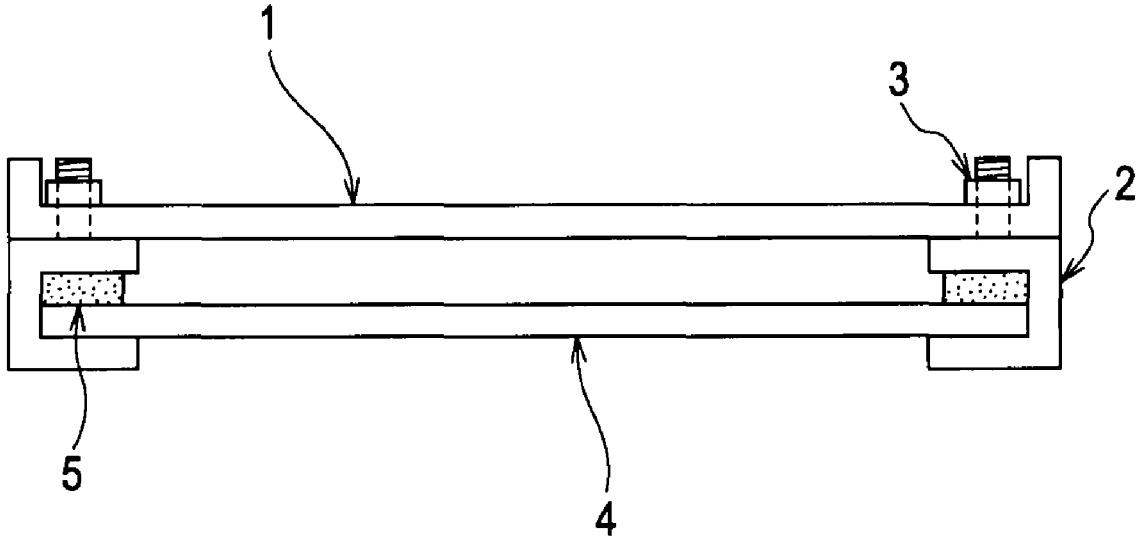
FIG. 1 shows a structure of a related art retainer mechanism.

Sound quality is further improved with the retainer mechanism according to the present embodiment shown in, for example, FIG. 3 than with the related-art retainer mechanism shown in FIG. 1. In other words, sound quality is further improved with the structure shown in FIG. 3, in which two edges of each diaphragm 31 are free and the remaining two edges are fixed, than the structure shown in FIG. 1, in which all the four edges of the diaphragm 4 are free.

Figure 7:
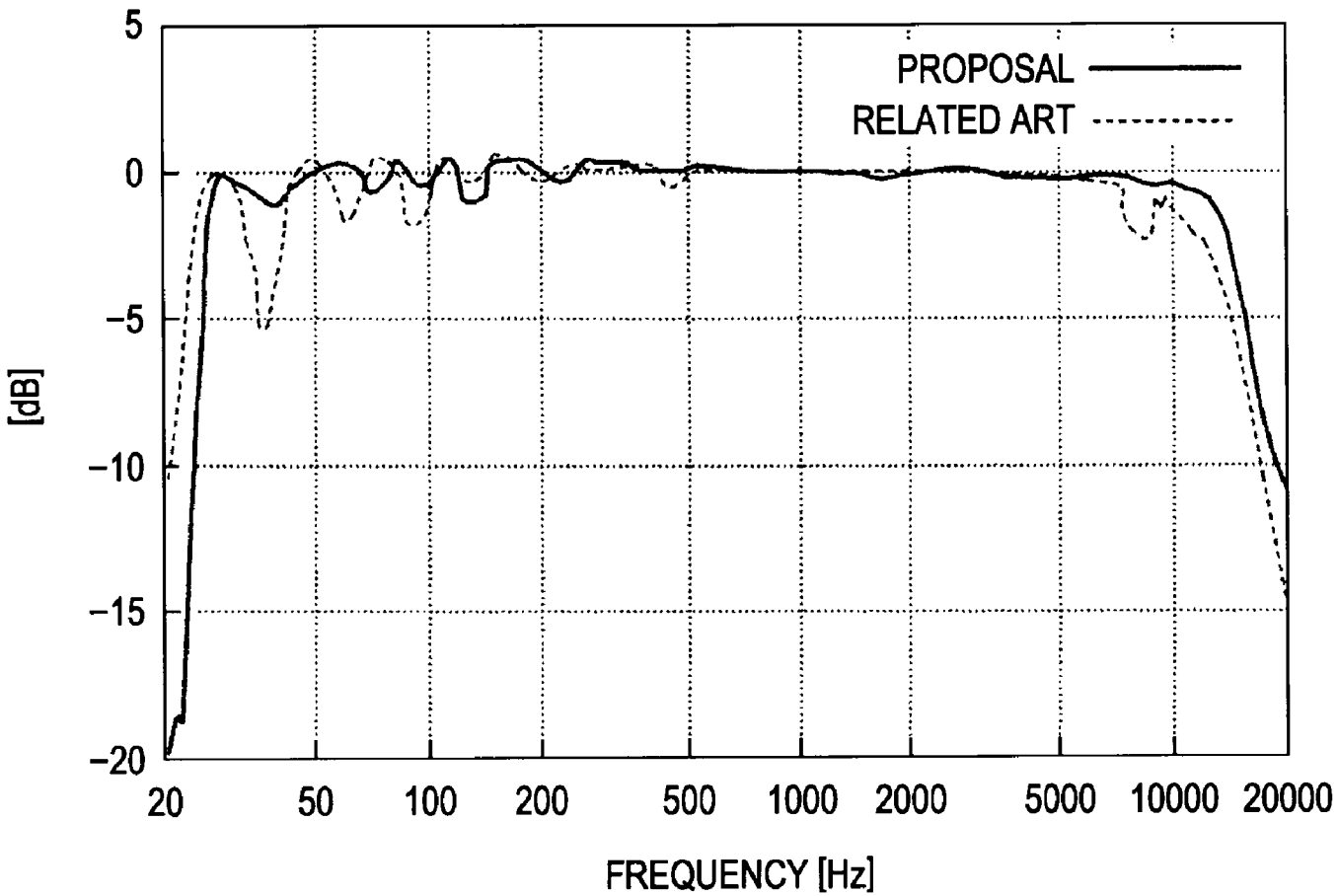
FIG. 7 is a graph showing frequency characteristics of two retainer mechanisms.

FIG. 7 is a graph showing frequency characteristics of sounds output from a diaphragm supported by the retainer mechanism shown in FIG. 1, and from a diaphragm supported by the retainer mechanism according to the present embodiment shown in FIG. 3. In FIG. 7, the frequency characteristic plotted as a solid line (denoted as "proposal") shows the frequency characteristic for the retainer mechanism according to the present embodiment shown in FIG. 3, and the frequency characteristic plotted as a dashed line (denoted as "related art") shows the frequency characteristic for the related-art retainer mechanism shown in FIG. 1.

In FIG. 7, a flatter line represents a better characteristic because it means that sound is output at an optimum level over the entire frequency range shown. Comparing the solid line with the dashed line in FIG. 7, the solid line is flatter than the dashed line. This shows that sound quality is improved more with the retainer mechanism according to the present embodiment shown in FIG. 3 than with the related-art retainer mechanism shown in FIG. 1.

Thus, sound quality is improved with the retainer mechanism according to the present embodiment.

As shown in FIG. 3, in order to prevent the diaphragms 31 from slipping down under their own weight, each diaphragm 31 has the holes 53 and allows the bolts 51 to extend therethrough, whereby the diaphragms 31 are supported. The holes 53 are not necessarily of a circular shape having a larger diameter than the bolt 51 as shown in FIG. 3, and they may be of another shape.

Figure 8A:
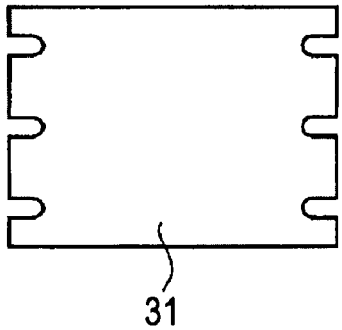
FIGS. 8A and 8B schematically show shapes of diaphragms.

For example, as shown in FIG. 8A, the diaphragms 31 may have semi-elliptical notches. The diaphragms 31 having semi-elliptical notches provide the same effect as the diaphragms 31 having circular holes. The diaphragms 31 having semi-elliptical notches further contribute to prevent the diaphragms 31 from slipping down under their own weight, because they are slightly lighter than the diaphragms 31 having circular holes.

Figure 8B:
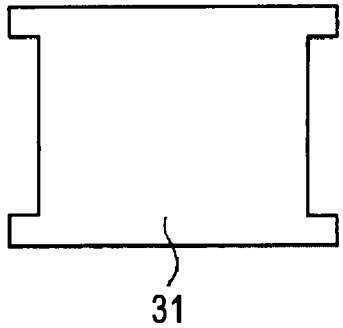

Alternatively, as shown in FIG. 8B, the diaphragms 31 may have rectangular notches. In this case, the bolts 51 contact the upper edges of the rectangular notches with the cushioning members 52 therebetween, and support the diaphragm 31. In this case, the plate 25A-2, for example, has to have only one bolt, namely, the bolt 51A-1. The diaphragms 31 as shown in FIG. 8B provide the same effect as the diaphragms 31 having circular holes, and the diaphragms 31 having semi-elliptical notches as shown in FIG. 8A.

Although FIGS. 3 and 8A show the diaphragms 31 in which three holes (notches) are disposed along the right and left edges thereof, the number of the holes (notches) is not limited thereto. A diaphragm having a single hole (notch), for example, also falls within the scope of the present invention. That is, basically, the necessary number of holes (notches) for supporting the weight of each diaphragm 31 should be provided.

As described above, the diaphragms 31 have portions that allow other members to extend therethrough. The diaphragms 31 are fixed to the frame 24, while the other members extend through the portions. As long as this structure is achieved, the shape of the diaphragms 31 and the shape of the portions that allow other members to extend therethrough may be modified.

As shown in FIGS. 3, 8A, and 8B, the holes (notches) are disposed along the right and left edges (short edges) of each diaphragm 31. In other words, the short edges of the diaphragms 31 are fixed, and the long edges of the diaphragms 31 are free. It is preferable to make the short edges fixed than to make the short edges free, taking the following points, which will now be described with reference to FIGS. 9A and 9B, into consideration.

Figure 9A:
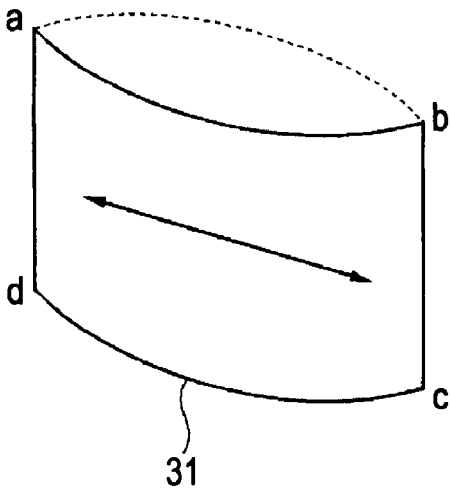
FIGS. 9A and 9B schematically show directions of sound propagation in the diaphragms.
Figure 9B:
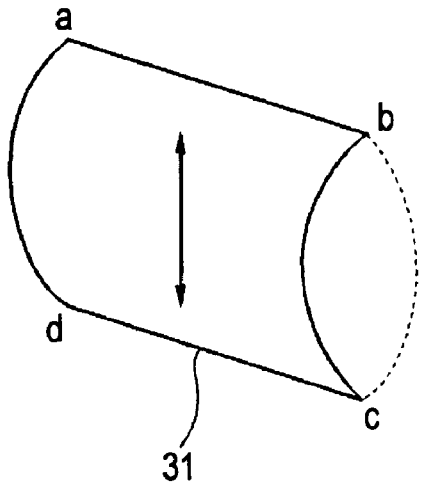

When the diaphragms 31 vibrate, the main vibration propagates parallel to the long edges ab and cd, as shown in FIG. 9A. This is because the vibration propagates more easily in this direction than in the direction parallel to the short edges bc and da, as shown in FIG. 9B. Thus, if the long edges, along which the main vibration propagates, are fixed, propagation of the main vibration is inhibited. Accordingly, it is preferable to make the short edges of the diaphragms 31 fixed.

As shown in FIG. 9A, sound quality and sound volume can be adjusted by changing the length of the diaphragms 31 in the lengthwise direction because the main vibration propagates parallel to the long edges. When the length of the diaphragms 31 in the lengthwise direction is increased, the size of vibrating surfaces of the diaphragms 31 is increased. This enables the diaphragms 31 to output high-volume, low-pitched sound. In contrast, when the length of the diaphragms 31 in the lengthwise direction is decreased, the size of the vibrating surfaces of the diaphragms 31 is decreased. This enables the diaphragms 31 to output low-volume, high-pitched sound.

For example, the screen speaker unit 11 shown in FIG. 2 has three diaphragms, namely, the diaphragms 31-1 to 31-3. It is possible to make the diaphragms 31-1 to 31-3 of the screen speaker unit 11 output high-pitched sound, middle-pitched sound, and low-pitched sound, respectively, by changing the size of the vibrating surfaces thereof.

The size of the vibrating surfaces of the diaphragms 31 can be adjusted by changing the length of the diaphragms 31 in the lengthwise direction. More specifically, referring back to FIG. 5, the length of the diaphragm 31-2 in the lengthwise direction (the portion in the diaphragm 31-2 which actually vibrates) can be reduced by increasing the length of the plates 54A and 54B in the lengthwise direction of the diaphragms 31. This will be described in more detail with reference to the drawings.

FIG. 10 shows only the diaphragm 31-2, the plates 25A-2, 25B-2, 54A, and 54B, and the bolts 51A-1 and 51B-1 of the retainer mechanism shown in FIG. 5. FIG. 10 schematically shows the diaphragm 31-2 while vibrating.

As shown in FIG. 10, the diaphragm 31-2 is disposed between the plates 25A-2 and 54A at one end, and between the plates 25B-2 and 25B at the other end. The diaphragm 31-2 vibrates using these portions (edges) disposed between the plates as supporting points. The thickness A of the plate 54A (54B) is set such that the diaphragm 31-2 does not contact the frame 24 (not shown in FIG. 10) when the diaphragm 31-2 vibrates. That is, the thickness A of the plate 54A (54B) is set to be larger than half the maximum amplitude of vibration B of the diaphragm 31-2.

The amplitude of vibration B of the diaphragm 31-2 depends on the material and thickness of the diaphragm 31-2. A thinner diaphragm has larger amplitude of vibration B than a thicker diaphragm if they are made of the same material. Thus, the plate 54A (54B) has to be thickened according to the amplitude of vibration B.

Figure 11:
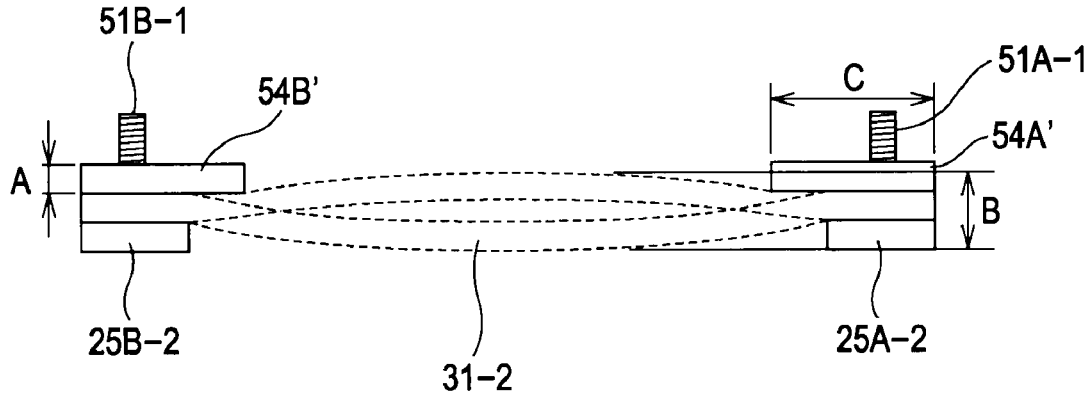
FIG. 11 shows a structure for customizing sound quality.

FIG. 11 is a view similar to FIG. 10, showing a retainer mechanism in which the width of the plates 54A and 54B has been increased. As described above, the volume and quality of sound can be adjusted by changing the width of the plate 54A. In FIG. 11, the plates 54A and 54B are denoted by plates 54A' and 54B' for distinction from the plates 54A and 54B shown in FIG. 10.

The plate 54A' shown in FIG. 11 has a larger width C than the plate 54A shown in FIG. 10. The plate 54B' shown in FIG. 11 also has a larger width C than the plate 54B shown in FIG. 10. Although the following description will be given under the assumption that the plates 54A' and 54B' have the same width C, the plates 54A' and 54B' may have different widths C.

When the width C of the plates 54A' and 54B' is increased, the supporting points are moved, that is, the supporting points approach each other. This reduces the amplitude of vibration B of the diaphragm 31-2, whereby the diaphragm 31-2 outputs low-volume, high-pitched sound.

When the diaphragm 31-2 shown in FIG. 10 and the diaphragm 31-2 shown in FIG. 11 are supplied with sounds of the same volume and quality, the diaphragm 31-2 shown in FIG. 11 outputs lower volume, higher-pitched sound than the diaphragm 31-2 shown in FIG. 10.

To output high-pitched sound while minimizing low-pitched sound, the width C of the plate 54A (54B) should be increased. To output low-pitched sound while minimizing high-pitched sound, the width C of the plate 54A (54B) should be decreased. The volume and quality of sound can be adjusted only by changing the width C of the plate 54A (54B).

This allows a user to customize the volume and quality of sound of the screen speaker unit 11 by changing the plate 54, if the user does not like the volume and quality of sound of the screen speaker unit 11 at the time of purchase. Thus, a user does not have to buy another speaker unit because the user can customize it.

Figure 12:
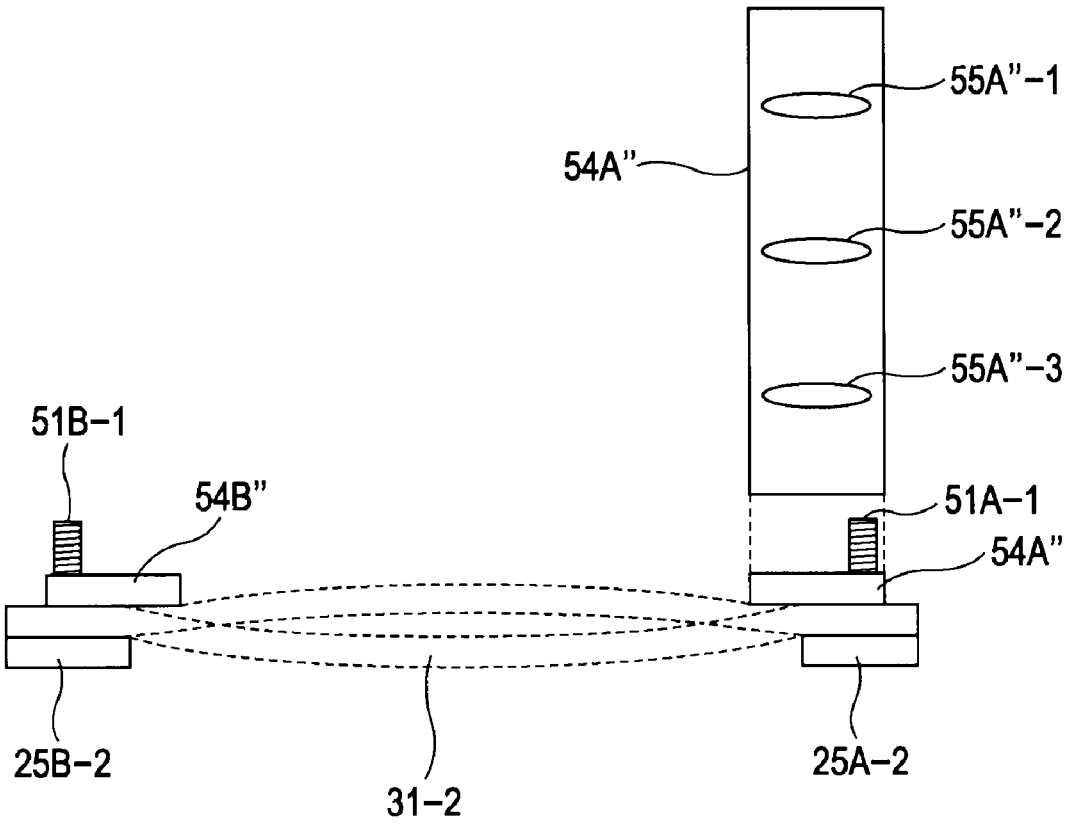
FIG. 12 shows a structure for customizing sound quality.

The width of the plates 54, i.e., the distance between the supporting points of diaphragms 31, may be changed using the plates as shown in FIG. 12. A plate 54A" shown in FIG. 12 has elongated holes 55A"-1 to 55A"-3. The holes 55A-1 to 55A-3 in the plate 54A shown in FIG. 3 are circular. In contrast, the holes 55A"-1 to 55A"-3 shown in FIG. 12 are substantially elliptical.

Substantially elliptical holes (hereinafter, elliptical holes) allow the bolts 51 to move therein. For example, the bolt 51A-1 is movable between the ends of the hole 55A"-1. To be more accurate, the bolts 51 do not move but the plate 54A" moves relative to the bolts 51 because the bolts 51 are fixed.

Accordingly, the distance between the supporting points of the diaphragm 31-2 can be changed by moving the plate 54A", not by replacing the plate 54. A user can customize the volume and quality of sound by moving the plate 54A", for example.

According to the present embodiment, it becomes possible to reduce a negative influence of the weight of diaphragms and to adjust the quality of sound and the like.

Although the width of the plates 54 is changed to customize the volume and quality of sound in the above-described embodiment, the width of the plates 25, not the plates 54, may be changed.

It should be understood by those skilled in the art that various modifications, combinations, sub-combinations and alterations may occur depending on design requirements and other factors insofar as they are within the scope of the appended claims or the equivalents thereof.

What is claimed is:

1. A sound output apparatus comprising:

a diaphragm for outputting sound when vibrated, the diaphragm having a hole of a predetermined shape at a side edge;

a first plate connected to a bolt, the first plate being attached to one surface of the diaphragm along a substantial length of the side edge having the hole;

a second plate having a hole, one surface of the second plate being attached to the other surface of the diaphragm along a substantial length of the side edge having the hole; and a frame to which the diaphragm is fixed, the frame being arranged adjacent to the other surface of the second plate, the frame having a hole, wherein the bolt extends through the hole in the diaphragm, the hole in the second plate, and the hole in the frame, and is secured by a nut, and wherein the diaphragm is fixed to the frame by the bolt and nut being screwed together, while being disposed between the first and second plates.

2. The sound output apparatus according to claim 1, further comprising a cushion disposed in the hole of the diaphragm, the cushion having a hole, and the bolt extending through the hole in the cushion.

3. The sound output apparatus according to claim 1, further comprising a cushion, wherein the diaphragm is rectangular, wherein the first and second plates are attached to a short edge of the diaphragm, and wherein the cushion is disposed along a long edge of the diaphragm, between the diaphragm and the frame.

4. The sound output apparatus according to claim 1, wherein the second plate has a thickness sufficient to prevent the diaphragm from contacting the frame when the diaphragm vibrates.

5. The sound output apparatus according to claim 1, wherein the size of a vibrating surface of the diaphragm is changed by changing the width of the second plate.

6. The sound output apparatus according to claim 1, wherein the hole in the second plate is elongated in a longitudinal direction of the diaphragm, and wherein the second plate is movable in the longitudinal direction of the diaphragm.

7. The sound output apparatus according to claim 1, further comprising a cushion, wherein the diaphragm and the cushion are disposed between the first and second plates.

* * * * *